US008479398B2

(12) United States Patent
Coresh

(10) Patent No.: US 8,479,398 B2
(45) Date of Patent: Jul. 9, 2013

(54) SHAVING ASSEMBLY

(76) Inventor: Leon Alon Coresh, Marina del Rey, CA (US)

( * ) Notice: Subject to any disclaimer, the term of this patent is extended or adjusted under 35 U.S.C. 154(b) by 96 days.

(21) Appl. No.: 12/745,797

(22) PCT Filed: Jul. 22, 2009

(86) PCT No.: PCT/IB2009/053169

§ 371 (c)(1),
(2), (4) Date: Jun. 2, 2010

(87) PCT Pub. No.: WO2010/010517

PCT Pub. Date: Jan. 28, 2010

(65) Prior Publication Data

US 2011/0192031 A1 Aug. 11, 2011

(30) Foreign Application Priority Data

Jul. 22, 2008 (GB) ..... 0813364.7

(51) Int. Cl.
*B26B 21/22* (2006.01)

(52) U.S. Cl.
USPC ..... 30/50; 30/34.1; 30/41

(58) Field of Classification Search
USPC ..... 30/34.1, 50, 41
See application file for complete search history.

(56) References Cited

U.S. PATENT DOCUMENTS

| | | | | |
|---|---|---|---|---|
| 4,516,320 | A * | 5/1985 | Peleckis | 30/49 |
| 5,152,064 | A | 10/1992 | Johnston | |
| 5,426,853 | A | 6/1995 | McNinch | |
| 5,781,997 | A * | 7/1998 | Ferraro et al. | 30/50 |
| 6,161,288 | A | 12/2000 | Andrews | |
| 6,311,400 | B1 * | 11/2001 | Hawes et al. | 30/527 |
| 6,397,473 | B1 * | 6/2002 | Clark | 30/50 |
| 6,434,828 | B1 | 8/2002 | Andrews | |
| 6,880,253 | B1 * | 4/2005 | Gyllerstrom | 30/527 |
| 7,086,160 | B2 * | 8/2006 | Coffin et al. | 30/532 |
| 7,131,203 | B2 * | 11/2006 | Wain | 30/57 |
| 7,721,446 | B2 * | 5/2010 | Royle | 30/49 |
| 8,136,249 | B2 | 3/2012 | Shiba | |
| 2004/0181949 | A1 | 9/2004 | Coffin et al. | |

(Continued)

FOREIGN PATENT DOCUMENTS

| | | |
|---|---|---|
| CN | 1212647 | 3/1999 |
| CN | 1469797 | 1/2004 |

(Continued)

OTHER PUBLICATIONS

Examination Report Dated Feb. 9, 2012 From the Intellectual Property Office of New Zealand Re. Application No. 591266.

(Continued)

*Primary Examiner* — Hwei C Payer
(74) *Attorney, Agent, or Firm* — Blakely Sokoloff Taylor & Zafman LLP

(57) ABSTRACT

A shaving assembly having plural independent flexibly mounted cartridges. The assembly comprises a cartridge support including two flexible cross members at opposing ends of a bridge member each at one of a pair of attachment points. The cross member is flexible into either a convex or a concave orientation about the respective attached point. The assembly further comprises a plurality of cartridges each including a carrier and at least one blade, each cartridge independently coupled to the cross members in a parallel relation to each other cartridge to the cross members.

10 Claims, 9 Drawing Sheets

U.S. PATENT DOCUMENTS

| | | | | |
|---|---|---|---|---|
| 2005/0188539 | A1 | 9/2005 | Prudden | |
| 2006/0064875 | A1* | 3/2006 | Follo et al. | 30/34.1 |
| 2006/0080839 | A1 | 4/2006 | Hesketh | |
| 2006/0143925 | A1* | 7/2006 | Johnson et al. | 30/50 |
| 2006/0196054 | A1* | 9/2006 | Luxton | 30/50 |
| 2008/0196251 | A1* | 8/2008 | Royle | 30/50 |
| 2011/0192031 | A1 | 8/2011 | Coresh | |
| 2012/0151772 | A1* | 6/2012 | Moon et al. | 30/41 |
| 2012/0324733 | A1 | 12/2012 | Coresh | |
| 2013/0000127 | A1 | 1/2013 | Coresh | |

FOREIGN PATENT DOCUMENTS

| | | | |
|---|---|---|---|
| EP | 0020816 | | 1/1981 |
| EP | 1046472 | | 10/2000 |
| GB | 2268434 | | 1/1994 |
| GB | 2411141 | | 8/2005 |
| WO | WO-9320983 | | 10/1993 |
| WO | WO 95/04637 | * | 2/1995 |
| WO | WO-9726119 | | 6/1997 |
| WO | WO 97/25189 | | 7/1997 |
| WO | WO-9725189 | | 7/1997 |
| WO | WO-0232632 | | 5/2002 |
| WO | WO 2004/087382 | | 10/2004 |
| WO | WO-2004087382 | | 10/2004 |
| WO | WO-2005090020 | | 9/2005 |
| WO | WO 2006/016591 | | 4/2006 |
| WO | WO-2006036591 | | 4/2006 |
| WO | WO 2010/010517 | | 1/2010 |

OTHER PUBLICATIONS

Search Report and Written Opinion Dated Apr. 18, 2012 from the Intellectual Property Office of Singapore issued by the Austrian Patent Office on Mar. 12, 2012 re Application No. 201100416-5.

Coresh, Leon A., International Search Report mailed Apr. 20, 2010, PCT Appln. No. PCT/IB2009/053169 filed Jul. 22, 2009, 7 pages.

Coresh, Leon A., International Preliminary Report on Patentability (Written Opinion) mailed Jan. 25, 2011 PCT Appln. No. PCT/IB2009/053169 filed Jul. 22, 2009, 8 pages.

Communication Pursuant to Rules 161(1) and 162 EPC Dated May 17, 2011 From the European Patent Office Re. Application No. 09786662.8.

International Preliminary Report on Patentability Dated Feb. 3, 2011 From the International Bureau of WIPO Re. Application No. PCT/IB2009/053169.

International Search Report and the Written Opinion Dated Apr. 20, 2010 From the International Searching Authority Re. Application No. PCT/IB2009/053169.

Communication Pursuant to Article 94(3) EPC dated May 30, 2012 From the European Patent Office re: Application No. 09786662.8.

Patents Act 1977: Combined Search and Examination Report Under Sections 17 And 18(3) Dated Nov. 18, 2008 from the UK (United Kingdom) Intellectual Property Office Re: Application No. GB0813364.7.

Translation of Office Action dated Nov. 14, 2012 from the State Intellectual Property Office of the People's Republic of China re 200980136872.8.

Examination Report Dated Nov. 27, 2012 from the Eurasian Patent Organization re Application No. 201100263 and its translation into English.

Examination Report Dated Jan. 31, 2013 from the Intellectual Property Office of New Zealand re Application No. 591266.

Search and Examination Report Dated Dec. 21, 2012 from the Intellectual Property Office of Singapore re: 201100416-5.

CORESH Communication Pursuant to Article 94(3) EPC Dated Apr. 5, 2013 From the European Patent Office Re. Application No. 09786662.8.

* cited by examiner

SHAVING ASSEMBLY

This is a non-provisional application of International Application No. PCT/IB2009/053169, filed Jul. 22, 2009.

FIELD OF THE INVENTION

The present invention is related to a personal care item, more particularly to a shaving device.

BACKGROUND

A diversity of shaving means is available in the market, for example manually operated, electric shavers, multiple use and disposable shaving devices. Typically, such shaving devices include a gripping handle for conveniently holding one or more cutting blades and a respective cartridge bearing one or more or those blades, secured within.

SUMMARY OF THE INVENTION

The present invention relates to an improved shaving assembly with features facilitating more convenient, and/or comfortable and/or more efficient shaving.

A shaving assembly having plural independent flexibly mounted cartridges is disclosed. A plurality of independent cartridges each having a carrier and at least one blade is mounted parallel to each other on a cartridge support having resiliently flexible mounting cross pieces. The cartridge support further includes a bridge spanning between mounting cross pieces.

In one embodiment of the present invention, a shaving assembly featuring a multiplicity of blades, comprises: at least two cartridges each bearing at least one blade; a blade cartridge support with two endings, each ending engageable with at least two cartridges and bridging between the cartridges and a handle interconnect; and a handle interconnect, having two endings, wherein the endings of the cartridge support are articulated facilitating their curving.

In another embodiment of the present invention, a shaving device featuring a multiplicity of blades, comprising: at least one cartridge, bearing at least one blade, mutually engageable with at least one other cartridge and separately engageable with a cartridge support; a blade cartridge support bearing two endings, each ending engageable with the at least two cartridges and bridging between the cartridges and a handle interconnect; a handle interconnect, bearing two endings, wherein the endings of the cartridge support are articulated facilitating their curving.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure not necessarily to the same embodiment, and such references mean at least one.

DESCRIPTION OF SOME EMBODIMENTS OF THE INVENTION

In accordance with the present invention a shaving assembly including a plurality of mechanically associated blades operable in a shaving device is provided. In such an association, each blade is secured within a respective cartridge, while each cartridge is linked directly or indirectly to an adjacent one or two cartridges. Typically, springs are disposed adjacent, typically below, some of the cartridges and a cartridge support, enabling a resilient curving of the blades. As a result, during shaving, the assembly of cartridges may assume a concave curvature, or a convex curvature depending on the surface of the skin being shaved.

Figure 1:
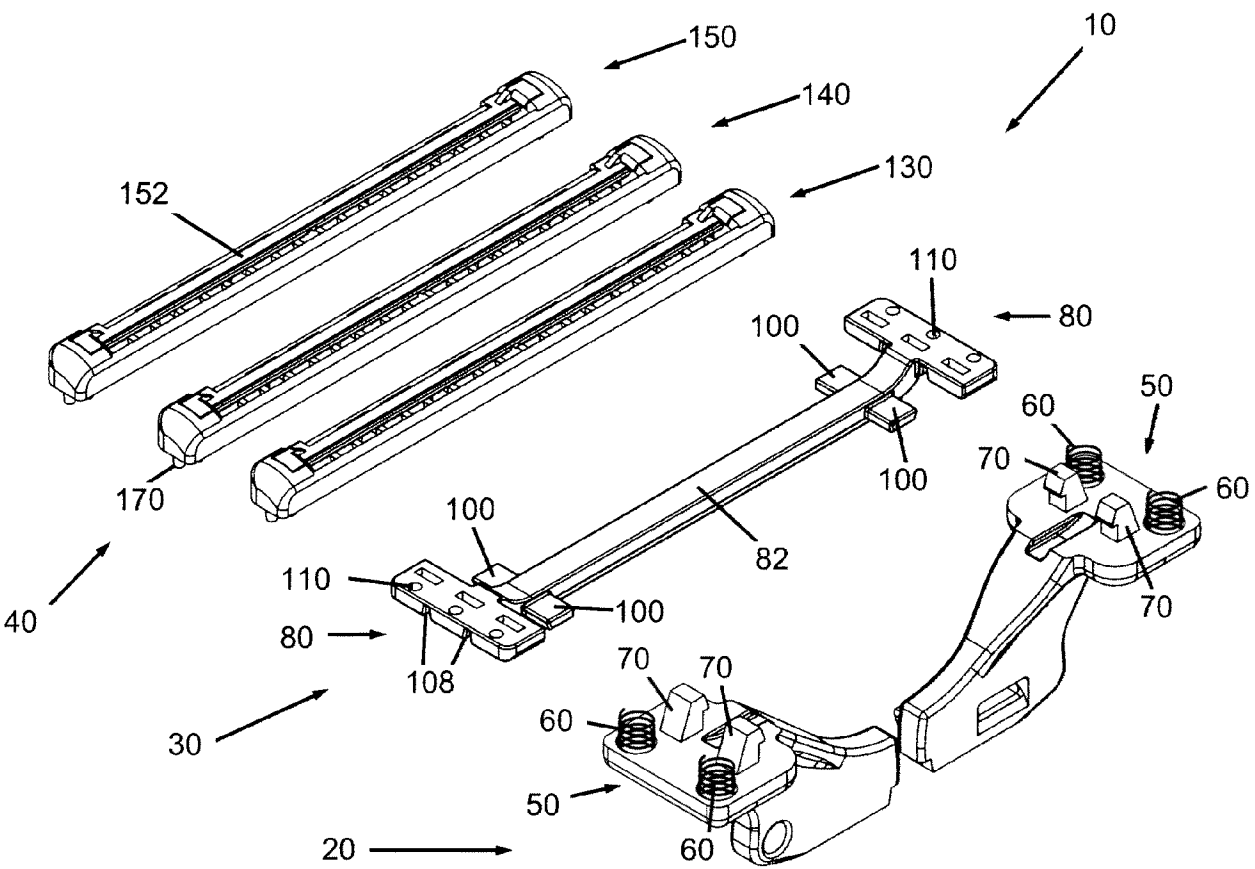
FIG. 1 is a schematic isometric top side exploded view of a first embodiment of a shaving cartridge of the present invention.

Reference is now made to FIG. 1, showing a schematic side exploded view of an exemplary shaving assembly of the present invention. Assembly 10 includes three modules: a handle interconnect 20, a cartridge support 30 and a set of cartridges 40 forming a triad. Handle interconnect 20 has a handle ending 50 including two springs 60 and two "L" shaped clasps 70. Both endings 80 of cartridge support 30 are raised from the plain of bridge 82. The role of endings 80 is to bridge between the cartridges 40 and the handle-interconnect 20. Two symmetric shelves 100 are disposed at the two flanks of bridge 82 respectively, pointing sideways so as to snugly fit, nested within "L" shaped clasps 70. Each ending 80 of cartridge support 30 is articulated by two cross slits 108 apparent on the underside of the endings. Three rectangular or round through-bores 110 and three rectangular through-recesses 120 are disposed on respective endings. Each of cartridges 130, 140 and 150 contain a blade 152. Each ending of cartridge 40 has pin 170 and a rectangular peg (not shown) pointing away from exposed blade 152. Each set of pins 170 and pegs of respective cartridge 40 are separately engageable within matching recesses 110 and 120. Handle interconnect endings 50 bear springs 60 or other resilient structures. The springs/structures subtend cartridges 130 and 150, excluding middle cartridge 140. Thus, when shaving, cartridges 130 and 150 are urged resiliently upwards by springs 60.

Figure 2:
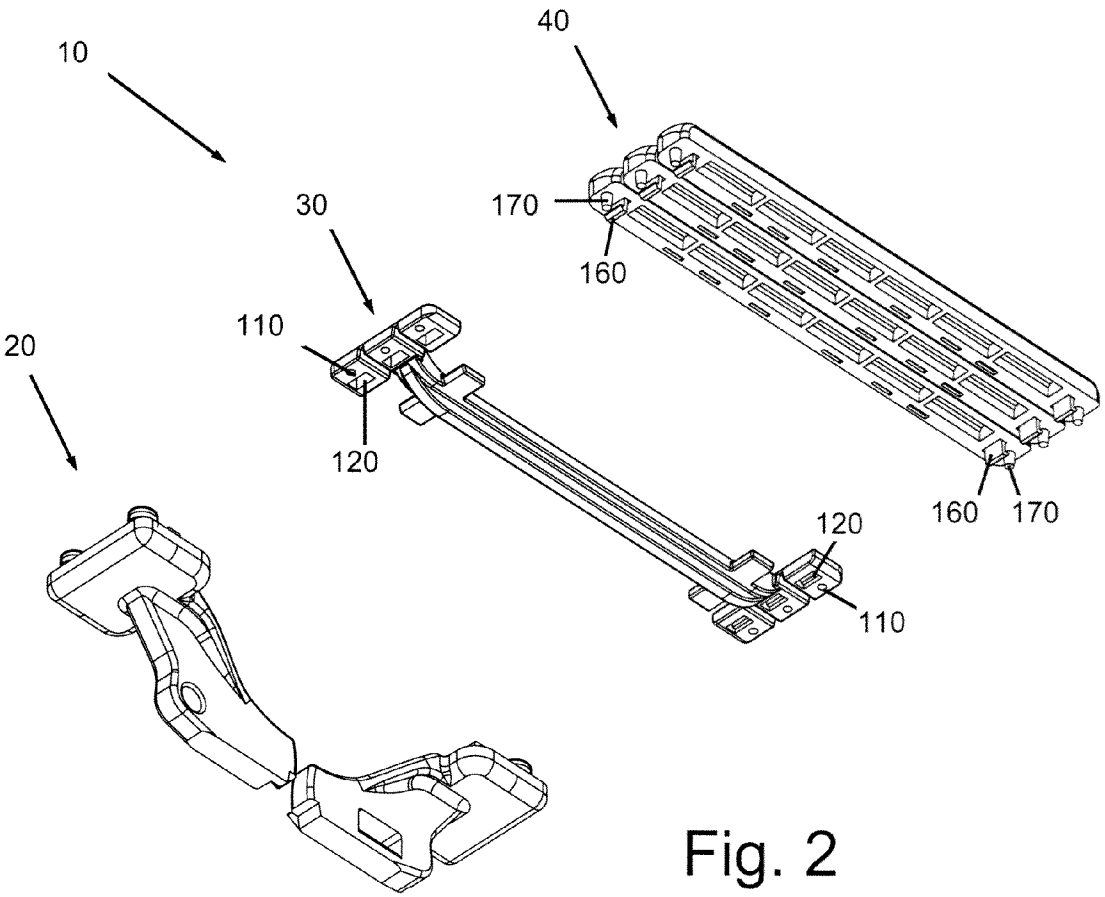
FIG. 2 is a schematic isometric underside diagonal exploded view of the embodiment of FIG. 1.

FIG. 2 shows another view of the three modules with handle interconnect 20, cartridge support 30 and a set of cartridges 40. From both endings of each cartridge 40, pins 170 and pegs 160 extend downward and are each engageable within recesses 110 and 120, respectively.

Figure 3:
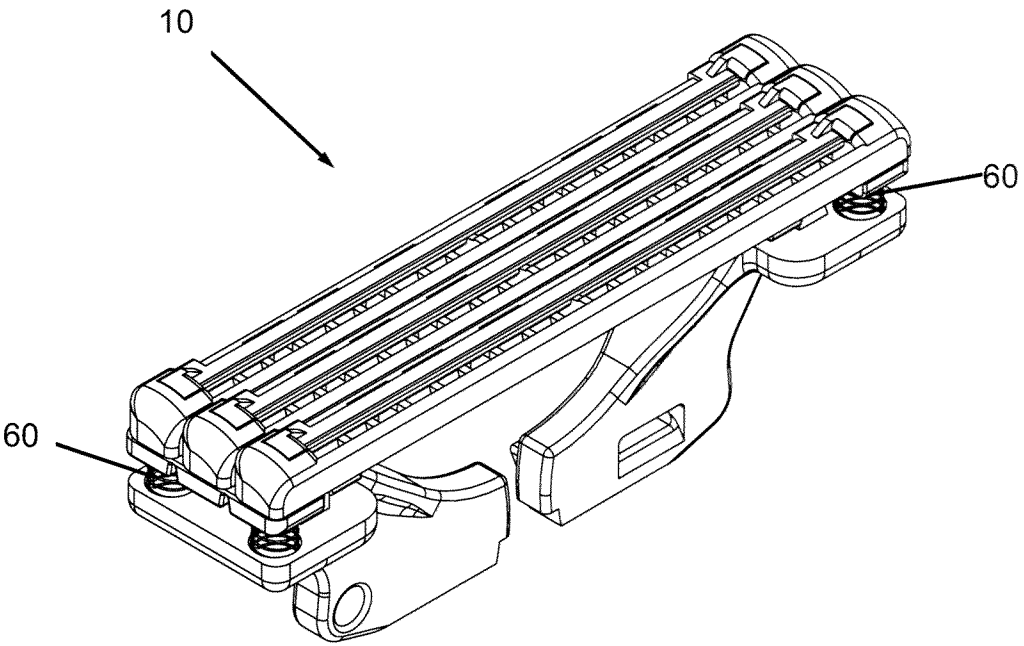
FIG. 3 is a schematic isometric view of an assembled shaving device of FIG. 2.

Referring now to FIG. 3, an isometric view of the fully assembled shaving assembly (excluding the handle) in accordance with an embodiment of the invention schematically shows how the cartridges 40 of the triad are supported by springs 60. As may be understood from above-described embodiment, typically the number of the resilient members, such as springs 60, equals the number of cartridges minus one.

Figure 4:
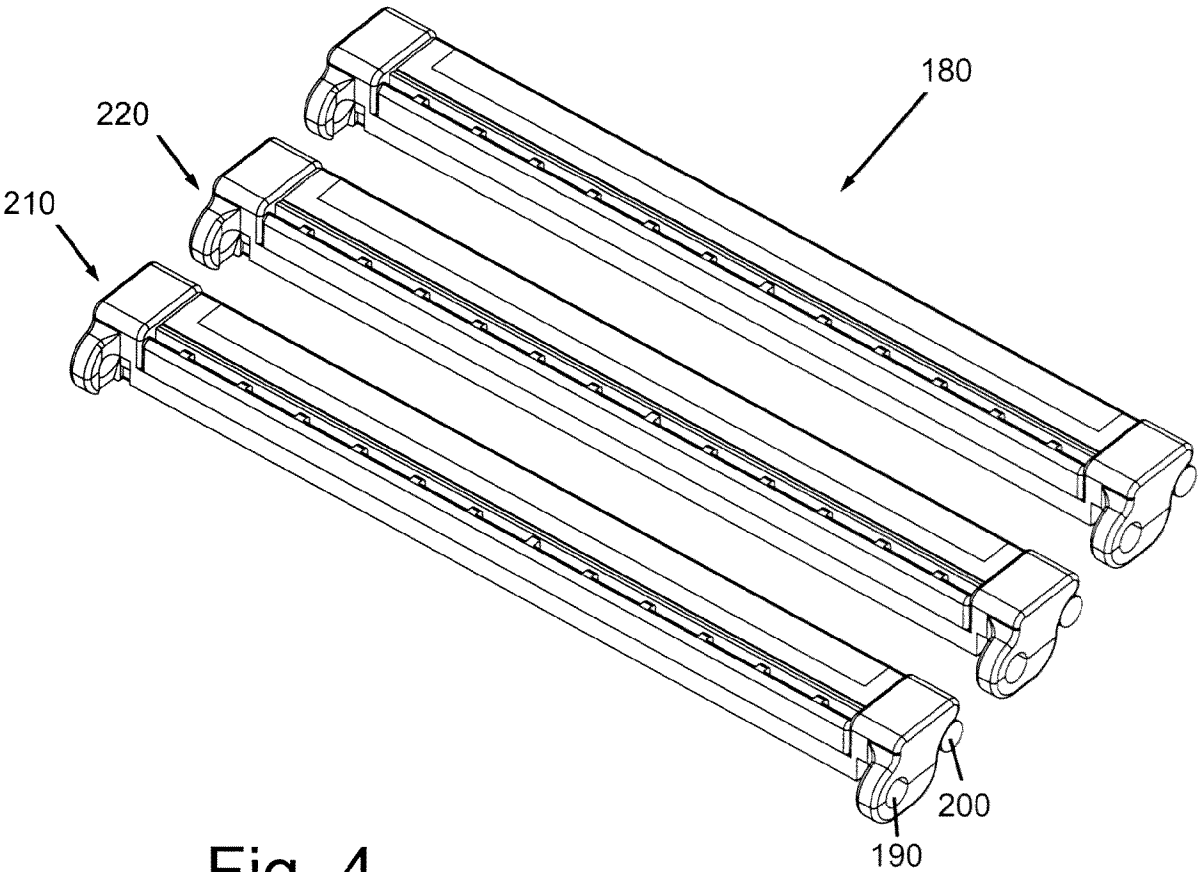
FIG. 4 is an exploded view of another embodiment of the shaving device with three housing cartridges.

FIG. 4 depicts an exploded schematic view of another embodiment of the present invention with three cartridges in a set 180. Each cartridge of set 180 is mutually engageable with either one or two other cartridges. Both endings of each of cartridges have one bore 190 and one pin 200. Thus, when the cartridges are assembled, bore 190 of cartridge 220 accommodates pin 200 of cartridge 220 and so forth.

Figure 5:
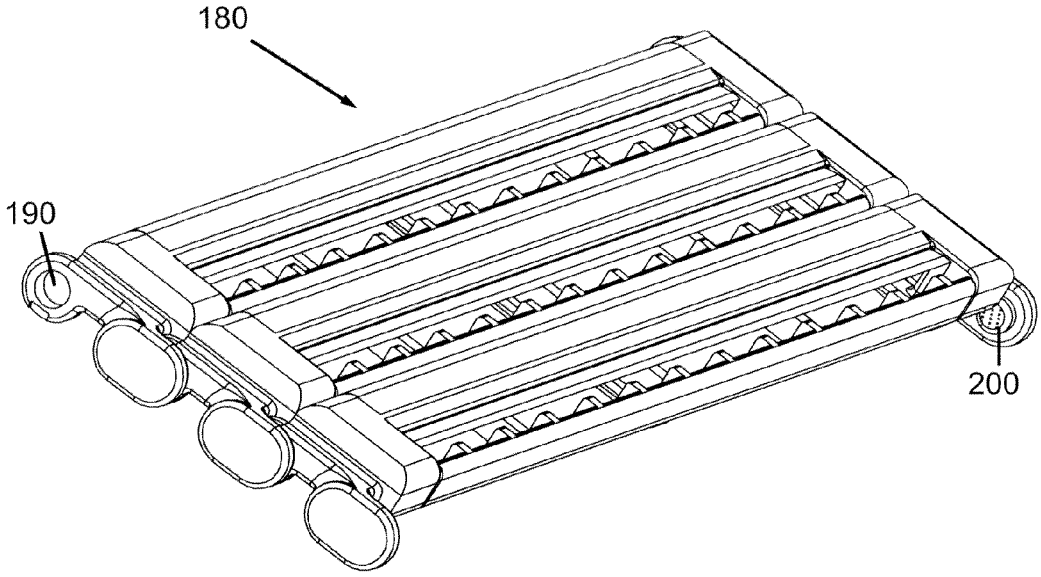
FIG. 5 is an isometric view of an additional embodiment of the present invention, showing a set of three assembled cartridges.

In FIG. 5, a schematic isometric view of the embodiment of the present invention is shown. Assembled set 180 consists of three cartridges. All interconnected serially. In one embodiment of the present invention, on each cartridge a lubricating strip 280 (see FIG. 6A) is disposed in front of first blade 152, meaning that the strip is located in front of the blades 152 in the direction of shaving. The strip 280 is typically infused with lubricating material, such as, for example aloe vera and/or coconut milk. In another embodiment of the present invention, an elastic rubber strip is disposed adjacent first blade 152 in the direction of shaving (for example, the blade of cartridge 130 in the exemplary embodiment). This elastomer strip is connected with the cartridge 130, thereby dictating the cartridge's flexibility, thus it facilitates the lifting of hair, guiding it towards the blades, while shaving. Such a feature is commercialized in other shaving equipment available for example as "Gillette soft microfins" [Gillette Inc., Boston, Mass. 02199, USA].

Figure 6B:
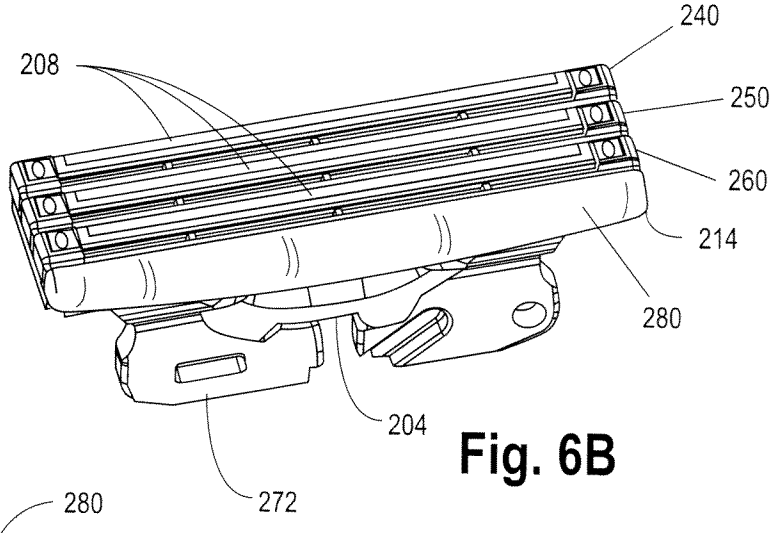
FIGS. 6A and 6B are schematic diagrams of a rear perspective view and a front perspective view, respectively, of a shaving assembly of an embodiment of the invention.
Figure 6A:
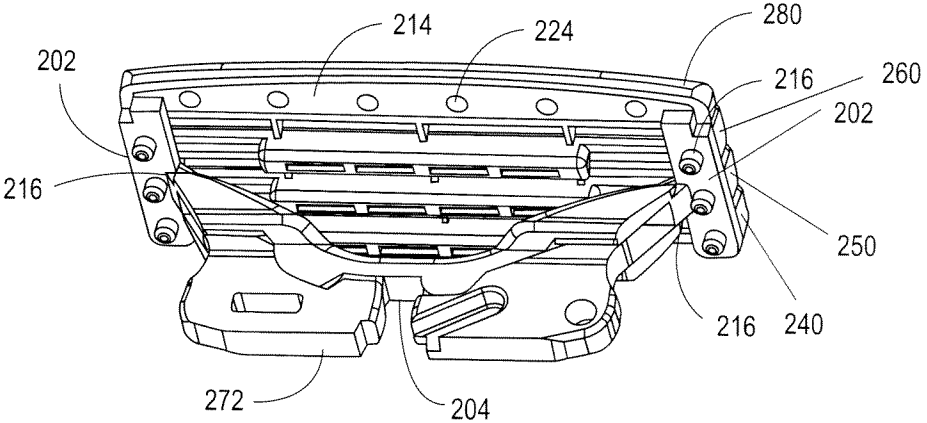

FIGS. 6A and 6B are schematic diagrams of a rear perspective view and a front perspective view respectively of a shaving assembly of one embodiment of the invention. A plurality of independent cartridges 240, 250 and 260 are coupled to a pair of cross pieces 202 of a cartridge support. Cartridge support also includes a bridge 204 spanning between cross pieces 202. Bridge 204 is coupled to each cross piece 202 at an attachment point 216.

In the shown embodiment, three independent cartridges, leading cartridge 260, middle cartridge 250 and following cartridge 240 are used. In one embodiment, each cartridge is independently attached to a cross piece 202 with middle cartridge 250 being attached substantially at the attachment point 216 and leading and following cartridges 260 and 240 being attached on either side adjacent thereto. The composition of each cartridge is described more fully with reference to FIG. 7 below.

Figure 8A:
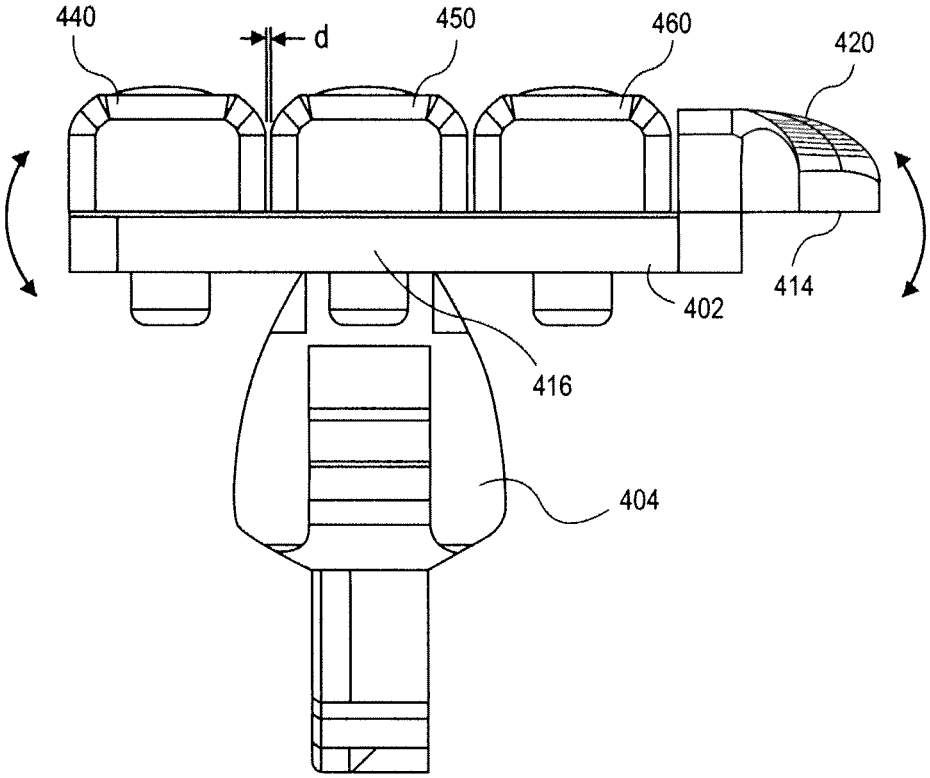
FIGS. 8A and 8B are schematic side views of a shaving assembly of an embodiment of the invention in a non-flexed and convex orientation, respectively.

Generally, cross pieces 202 are flexible and can flex between a concave and a convex orientation. This is discussed more fully below with reference to FIGS. 8A and 8B. At rest, e.g., when no forced is applied, cross pieces 202 are substantially planar. Cartridges 240, 250 and 260 may be attached to cross pieces 202 using adhesive, rivets, heat welding or any conventional attachment mechanism or a combination thereof. The positioning of the cartridges along cross piece 202 and in particular the finite space "d" between each cartridge pair (better shown in FIGS. 8A and 8B) dictates the amount of concavity that a face of the razor can achieve before contact between the adjacent cartridges prevents further movement. Because each of the cartridges 240, 250 and 260 is independent, the relative movement one cartridge as the razor face becomes convexed is not affected by the other cartridges. Such movement is only constrained by the flexibility and resilience of the cross piece 202.

As used herein, "leading" refers to earlier in position relative to the direction of shaving. Thus, leading cartridge 260 encounters an area to be shaved before middle cartridge 250 as the assembly is pulled along the shaving area. In one embodiment, the shaving assembly includes a leading platform 214 on which may be disposed a lubricating strip 280. Leading platform 214 may be attached to or formed with cross pieces 202. Lubricating strip 280 is positioned to release lubrication in advance of leading cartridge 260.

In some embodiments, each cartridge may also have its own lubricating strip 280, which lubricates the area to be shaved before the next successive cartridge arrives. Leading platform 214 may include perforations 224 to improve the adhesion of the lubricating strip 280. In an alternative embodiment, lubricating strip 280 may be replaced with flexible ribs or mirror fans that raise the drain in advance of leading cartridge 260. A handle interconnect 272 is coupled to the bridge 204 to allow the shaving assembly to be coupled to a razor handle. Handle interconnect 272 may provide for reciprocation of the entire assembly when attached to a handle. Razor interconnect 272 may have any necessary configuration to allow it to connect to the myriad possible razor handles commercially available or subsequently designed.

Figure 7:
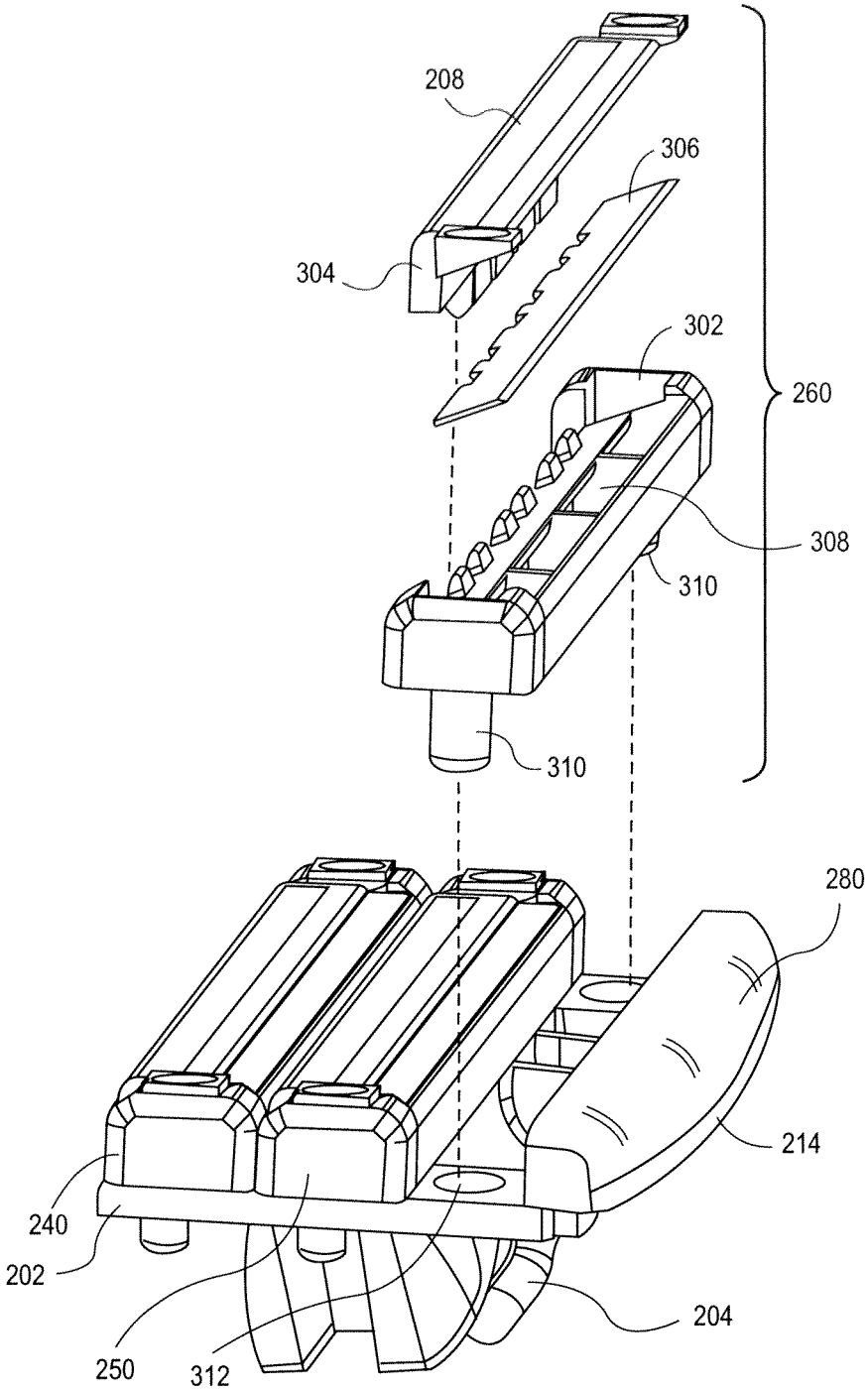
FIG. 7 is an exploded view of a razor assembly in an embodiment of the invention.

FIG. 7 is an exploded view of the shaving assembly in one embodiment of the invention. Leading cartridge 260 is shown exploded. Each cartridge includes a blade 306 and a carrier having a base 302 and a cap 304, which together retain the blade 306. The base 302 and cap 304 may be injection molded out of any suitable plastic or other material, for example, extruded from plastic or aluminum. In one embodiment, base 302 is integrally formed with mounting pegs 310 extending therefrom. Mounting pegs 310 engage holes 312 in cross piece 202 and may be heat welded or otherwise adhered therein. Cap 304 is designed to snap fit into base 302 to retain blade 306. Base 302 defines channels 308 through which shaved hair may pass without clogging or blocking blade 306.

In various embodiments, cross piece 202 may be formed from commercially available elastomeric nylon 12, polyurethane, or any other suitably resilient synthetic material. Generally, it is desirable for cross piece 202 to have sufficient resilience to deform and return to its generally planar original state for at least 8000 cycles. Resilience of 10,000 cycles or more is preferred. In some embodiments, cross piece 202 and bridge 204 are molded or extruded integrally as a unit. In some other embodiments, cross piece 202 and base 302 are molded integrally as a unit. It should be noted that when the bases 302 of each cartridge can be formed integrally as one piece with each other and that in such case there is no need for a bridge 204.

Figure 8B:
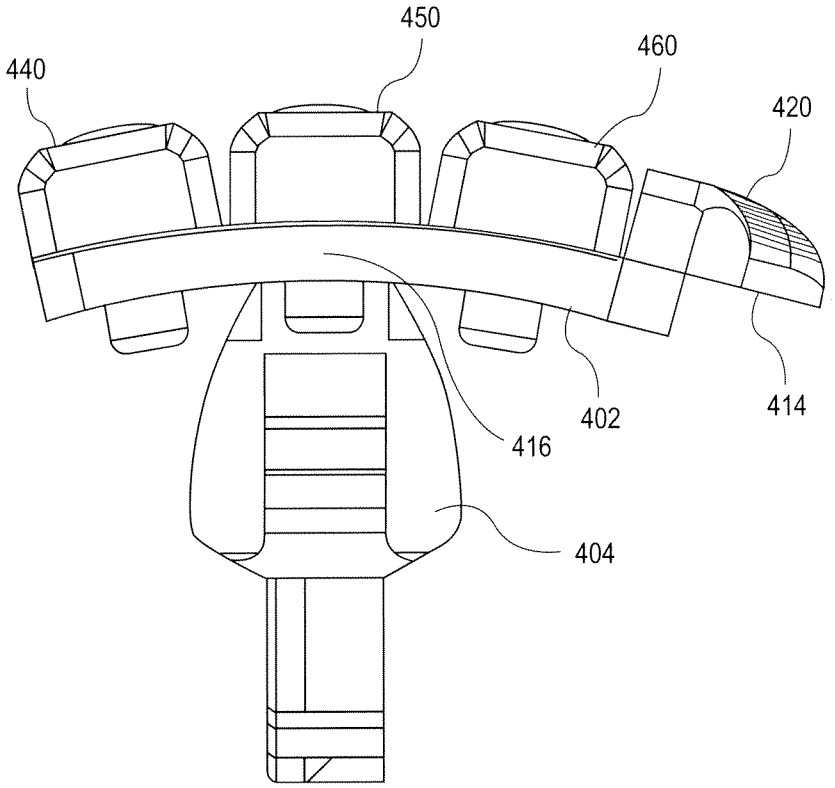

FIGS. 5A and 8B are schematic side views of a shaving assembly an embodiment of the invention, in an unflexed and a convexed orientation, respectively. A cross member 402 is coupled to a bridge 404 and retains independent cartridges 440, 450 and 460. The bidirectional arrows in the figure are indicative of the ability of the cross members 402 to flex around attachment point 416 into either a concave or a convex orientation. Finite space "d" exists between adjacent cartridge pairs 440, 450 and 460. The finite space "d" dictates the amount by which cross member 402 can flex to concave the face of the shaving assembly. As cross member 402 flexes into a concave orientation adjacent cartridges come into contact and prevent further concavity. In the absence of a finite space "d", cross member 402 (once assembled) will only be able to flex in a direction to cause the face to become convexed. The convex orientation assists in shaving a tight area, such as under a user's nose while the concave orientation assists in shaving around angular portions, such as the chin. Generally speaking, the need for convex flexibility exceeds that for concave flexibility. In the shown embodiment, leading platform 414 supports a series of micro ribs 420, which may be formed of an elastomeric material and are designed to lift the hair in advance of the blade from leading cartridge 460. It should be understood that the micro ribs 420 could be replaced in whole or in part by a lubricating strip on the leading platform 414.

FIG. 8B shows cross member 402 flexed in a convexed, orientation leading about attachment point 416. As previously noted, this orientation makes it easier to get into tight spaces, such as around a user's nose. Notably, leading platform 414 provides leverage to facilitate this flexion as a user presses the assembly against the area to be shaved wherein the leading platform 414 provides a lever arm to initiate bending about attachment point 416.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A shaving assembly comprising:

a cartridge support including two flexible cross members at opposing ends of a bridge member each at one of a pair of attachment points, the cross members flexible into either a convex or a concave orientation about the respective attachment points;

a plurality of cartridges each including a carrier and at least one blade, each cartridge independently coupled to the cross members in a parallel relation to each other wherein each blade has a cutting edge aligned to cut in a same direction.

2. The assembly of claim 1 wherein each cartridge further comprises a lubricating strip coupled to the carrier.

3. The assembly of claim 1 wherein the cartridge support is integrally molded as a single unit.

4. The assembly of claim 1 further comprising a leading platform coupled to the cartridge support in front of a first cartridge of the plurality of cartridges.

5. The assembly of claim 4 further comprising a lubricating strip disposed on the leading platform.

6. The assembly of claim 4 further comprising a plurality of flexible ribs disposed on the leading platform.

7. The assembly of claim 1 wherein the cross members are substantially when not exposed to a force.

8. The assembly of claim 1 wherein the cartridges are coupled to the cross members with one of rivets, heat welding or an adhesive.

9. A shaving assembly comprising:

a cartridge support including two flexible cross members at opposing ends of a bridge member each at one of a pair of attachment points, the cross members flexible into either a convex or a concave orientation about the respective attachment points;

a plurality of cartridges each including a carrier and at least one blade, each cartridge independently coupled to the cross members in a parallel relation to each other, wherein the plurality of cartridges is greater than two and wherein adjacent cartridges are coupled to the cross members with a finite space therebetween.

10. A shaving assembly comprising:

a cartridge support including two flexible cross members at opposing ends of a bridge member each at one of a pair of attachment points, the cross members flexible into either a convex or a concave orientation about the respective attachment points;

a plurality of cartridges each including a carrier and at least one blade, each cartridge independently coupled to the cross members in a parallel relation to each other, wherein the plurality of cartridges is an odd number and wherein one cartridge of the plurality of adjacent cartridges is coupled to the cross members at substantially the attachment points and the other cartridges are coupled to the cross members in equal numbers on opposite sides of the attachment points.

* * * * *

UNITED STATES PATENT AND TRADEMARK OFFICE

CERTIFICATE OF CORRECTION

PATENT NO. : 8,479,398 B2
APPLICATION NO. : 12/745797
DATED : July 9, 2013
INVENTOR(S) : Leon Alon Coresh It is certified that error appears in the above-identified patent and that said Letters Patent is hereby corrected as shown below:

On Title Page 2, Column 1, line 14, in Item [56] under References Cited, Foreign Patent Documents, please delete "WO WO2006016591 4/2006".

In the Claims, Column 6, Claim 7, line 6, please delete "substantially" and insert --substantially planar--.

Signed and Sealed this
Third Day of September, 2013

Teresa Stanek Rea
*Acting Director of the United States Patent and Trademark Office*